US011246382B2

(12) United States Patent
Kumei et al.

(10) Patent No.: US 11,246,382 B2
(45) **Date of Patent: *Feb. 15, 2022**

(54) COPPER ALLOY FASTENER ELEMENT AND SLIDE FASTENER

(71) Applicant: YKK Corporation, Tokyo (JP)

(72) Inventors: Takanori Kumei, Kurobe (JP); Atsushi Ogihara, Kurobe (JP); Chikako Hiromi, Kurobe (JP); Yoshio Taira, Kurobe (JP); Muneyoshi Yokota, Kurobe (JP); Takahiro Fukuyama, Kurobe (JP); Kouta Kido, Kurobe (JP)

(73) Assignee: YKK Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/085,256

(22) Filed: Oct. 30, 2020

(65) Prior Publication Data

US 2021/0045502 A1 Feb. 18, 2021

Related U.S. Application Data

(63) Continuation of application No. 16/320,088, filed as application No. PCT/JP2016/071901 on Jul. 26, 2016, now Pat. No. 10,918,171.

(51) Int. Cl.
*C22C 9/04* (2006.01)
*A44B 19/14* (2006.01)
(Continued)

(52) U.S. Cl.
CPC ..... *A44B 19/14* (2013.01); *A44B 19/24* (2013.01); *B21C 1/02* (2013.01); *B21D 53/36* (2013.01);
(Continued)

(58) Field of Classification Search
CPC ..... A44B 19/14; B21C 1/02; B21D 53/36; C22C 9/04; C22C 9/00; C22F 1/08
See application file for complete search history.

(56) References Cited

U.S. PATENT DOCUMENTS 9,023,272 B2 * 5/2015 Yoshimura ..... C22C 9/04 420/469
2002/0110478 A1 * 8/2002 Lawrence ..... C22C 9/00 420/476
(Continued)

FOREIGN PATENT DOCUMENTS

JP 08337831 12/1996
JP 08337831 A * 12/1996
(Continued)

OTHER PUBLICATIONS

U.S. Appl. No. 16/320,088 , Non-Final Office Action, dated Oct. 31, 2019, 8 pages.
(Continued)

*Primary Examiner* — Jason W San
(74) *Attorney, Agent, or Firm* — Kilpatrick Townsend & Stockton LLP

(57) ABSTRACT

Provided is a copper alloy fastener element which improves season cracking resistance by a means different from that of increasing a ratio of a β phase. The copper alloy fastener element includes a copper-zinc alloy as a base material, the base material having: an apparent zinc content of from 34 to 38%; a dendrite structure; and a β phase at a ratio of 10% or less.

9 Claims, 5 Drawing Sheets

(51) Int. Cl.

| | |
|---|---|
| ***B21C 1/02*** | (2006.01) |
| ***B21D 53/36*** | (2006.01) |
| ***C22F 1/08*** | (2006.01) |
| ***A44B 19/24*** | (2006.01) |
| ***B21F 45/16*** | (2006.01) |

(52) U.S. Cl.
CPC ..... *B21F 45/16* (2013.01); *C22C 9/04* (2013.01); *C22F 1/08* (2013.01)

(56) References Cited

U.S. PATENT DOCUMENTS

| | | | | |
|---|---|---|---|---|
| 2003/0110600 | A1* | 6/2003 | Kikukawa | C23C 18/52 24/399 |
| 2003/0110601 | A1* | 6/2003 | Sugimoto | A44B 19/00 24/436 |
| 2011/0002809 | A1* | 1/2011 | Lo | B22D 21/025 420/478 |
| 2012/0027638 | A1* | 2/2012 | Kosaka | C22C 9/04 420/471 |
| 2012/0073712 | A1* | 3/2012 | Dewobroto | C22C 9/02 148/554 |
| 2014/0190596 | A1* | 7/2014 | Inoue | C22C 9/00 148/554 |
| 2015/0218674 | A1* | 8/2015 | Kido | C22F 1/08 420/482 |
| 2015/0225818 | A1* | 8/2015 | Goto | C22C 1/0491 419/28 |
| 2017/0349976 | A1* | 12/2017 | Yoshimura | C22C 9/04 |
| 2018/0049520 | A1* | 2/2018 | Fukuyama | A44B 19/403 |
| 2018/0049521 | A1* | 2/2018 | Koizumi | C23F 11/00 |
| 2019/0062876 | A1* | 2/2019 | Weber | C22F 1/08 |

FOREIGN PATENT DOCUMENTS

| | | | | |
|---|---|---|---|---|
| WO | 2012004841 | | 1/2012 | |
| WO | WO-2012004841 | A1 * | 1/2012 | C22F 1/08 |
| WO | 2014024293 | | 2/2014 | |
| WO | WO-2014024293 | A1 * | 2/2014 | A44B 19/00 |

OTHER PUBLICATIONS

U.S. Appl. No. 16/320,088 , Non-Final Office Action, dated Jul. 2, 2020, 9 pages.

International Patent Application No. PCT/JP2016/071901, International Preliminary Report on Patentability, dated Feb. 7, 2019, 6 pages.

International Patent Application No. PCT/JP2016/071901, International Search Report, dated Oct. 11, 2016, 3 pages.

* cited by examiner

COPPER ALLOY FASTENER ELEMENT AND SLIDE FASTENER

CROSS-REFERENCE TO RELATED APPLICATIONS

This application is a continuation of U.S. application Ser. No. 16/320,088, filed Jan. 23, 2019, the entire contents of which are incorporated herein by reference.

TECHNICAL FIELD

The present invention relates to a copper alloy fastener element. The present invention also relates to a slide fastener including the fastener elements.

BACKGROUND

Conventionally, fastener elements made of metal materials, which are engaging members for a slide fastener, are known in the art. Among the metal materials, in particular copper-zinc alloys represented by red brass, brass, and nickel silver are widely used. Zinc has an effect of increasing strength, hardness and uniform deformation amount of the copper alloy by solid solution. Further, zinc can allow an inexpensive alloy having good characteristics to be obtained because zinc is cheaper than copper. However, there is a problem that the presence of a zinc element in copper remarkably deteriorates corrosion resistance. Further, when a slide fastener is produced by using a copper alloy having an increased amount of zinc and implanting the alloy into a base fabric by in particular cold working, a problem of season cracking is caused due to residual stresses.

The season cracking is a phenomenon in which cracks are generated on an outer surface of a product when a copper-zinc alloy having residual stress therein is exposed to a corrosive environment such as ammonia gas. It is known that such a problem of season cracking tends to occur in a copper-zinc alloy having a zinc content of 10% by mass or more. Therefore, it is considered that a ratio of zinc should be decreased to be less than 10% by mass in order to improve season cracking resistance of the copper-zinc alloy. However, such an alloy causes a high material cost as well as an insufficient strength, which is not desirable as a copper alloy for elements.

Further, it is conventionally known to add a third element(s) or perform an annealing treatment for removing processing strains as a measure for preventing season cracking. For example, for the addition of the third element it is known that the season cracking resistance is improved by adding to the copper-zinc alloy the third element such as tin in an amount of several percentages.

However, there is a problem that material costs are increased because any of the third elements which have been confirmed to have the season cracking prevention effect is more expensive than zinc. Further, the addition of the third element such as tin to the copper-zinc alloy causes disadvantages that it deteriorates cold workability of the copper-zinc alloy so that the cold working at a high rolling reduction rate becomes impossible.

Under such circumstances, WO 2012/004841 (Patent Document 1) discloses a copper-zinc alloy product composed of a copper-zinc alloy containing more than 35 wt % and 43 wt % or less of zinc and having a two-phase structure of an α phase and a β phase, wherein a ratio of the β phase in the copper-zinc alloy is controlled to be greater than 10% and less than 40%, and wherein crystal grains of the α phase and the β phase are crushed into a flat shape by cold working so that the crystal grains are arranged in the form of layer. This document also discloses that a heat treatment is carried out at a temperature of from 400 to 700° C. in order to adjust the ratio of the β phase.

CITATION LIST

Patent Literatures

Patent Document 1: WO 2012/004841 A1

SUMMARY

Technical Problem

The β phase (body-centered cubic structure) in the copper-zinc alloy is a harder structure than the α phase (face-centered cubic structure), and strength of the copper-zinc alloy can be improved by increasing the ratio of the β phase. However, on the other hand, there is still a problem of lowering the cold workability of the copper-zinc alloy and shortening mold life. Therefore, it would be advantageous if it is possible to improve the season cracking resistance by a means different from that of increasing the ratio of the β phase.

The present invention has been made in view of the above circumstances. One of objects of the present invention is to provide a copper alloy fastener element which improves season cracking resistance by a means different from that of increasing the ratio of the β phase, and which further improves mold life.

Solution to Problem

The present inventors have made extensive studies in order to solve the above problems, and found that a copper-zinc alloy with a predetermined composition having a dendrite structure maintaining a small β-phase ratio is effective for solving the problems. The present inventors have completed the present invention based on such findings.

In one aspect, the present invention relates to a copper alloy fastener element comprising a copper-zinc alloy as a base material, the base material having: an apparent zinc content of from 34 to 38% by mass; a dendrite structure; and a β phase at a ratio of 10% or less.

In one embodiment, the copper alloy fastener element according to the present invention, wherein the base material contains from 34 to 38% by mass of Zn.

In another embodiment, the copper alloy fastener element according to the present invention comprises: a pair of leg portions for being fixed by sandwiching to a core cord portion provided on one side edge of a fastener tape; a crotch portion for connecting the leg portions; and a head portion provided from the crotch portion in a direction opposite to the leg portions, the head portion comprising an engaging concave portion and an engaging convex portion, and wherein the base material on an inner side surface of the crotch portion to be in contact with the core cord portion has at least the dendrite structure.

In yet another embodiment of the copper alloy fastener element according to the present invention, the ratio of the β phase in the base material is from 2 to 10%.

In yet another embodiment of the copper alloy fastener element according to the present invention, the base material has been produced through an annealing step under heating conditions where a diffusion distance of copper is from 0.5 to 3.0 nm, after casting.

In another aspect, the present invention relates to a fastener chain comprising at least one copper alloy fastener element according to the present invention.

In yet another aspect, the present invention relates a slide fastener comprising the fastener chain according to the present invention.

In yet another aspect, the present invention relates to an article comprising the slide fastener according to the present invention.

In another aspect, the present invention relates to a method for producing a copper alloy fastener element, the method comprising:

producing a deformed wire having a substantially Y-shaped cross section by sequentially carrying out the steps of:

heating and melting a copper-zinc alloy having an apparent zinc content of from 34 to 38% by mass and then continuously casting in one direction to obtain a wire having a β phase and a dendrite structure;

drawing the obtained wire;

subjecting the drawn wire to annealing under heating conditions where a diffusion distance of copper is from 0.5 to 3.0 nm; and subjecting the annealed wire to cold rolling; and then forming the resulting deformed wire.

Advantageous Effects of Invention

According to the present invention, it is possible to provide a copper alloy fastener element having improved season cracking resistance by a means different from that of increasing a ratio of a β phase. Therefore, according to the present invention, it is possible to improve the season cracking resistance while decreasing the ratio of the β phase which would adversely affect the cold workability and the mold life, so that a copper alloy fastener element having improved industrial productivity can be obtained, which can have an extremely high industrial utility value.

Figure 1:
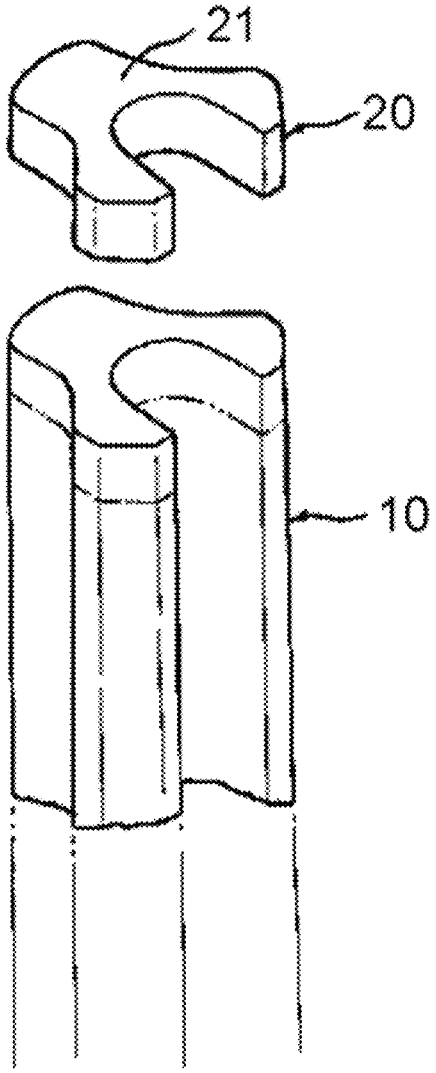
FIG. 1 is a view for explaining a method of obtaining a Y-shaped member by cutting a Y-shaped deformed wire.

DETAILED DESCRIPTION (1. Composition of Base Material)

In one embodiment, a fastener element according to the present invention includes a base material made of a copper alloy having an apparent zinc content of from 34 to 38% by mass. The apparent zinc content can be expressed by the following equation. It is known that when third element(s) is/are added to a copper-zinc alloy, a structure similar to that where Zn is increased or decreased depending on "Zn equivalent" according to the third element(s) is generated and exhibits corresponding properties ("Foundation and Industrial Technology for Copper and Copper Alloy", Japan Elongated Copper Association, 1994).

$$B'=(B+\Sigma tq)/(A+B+\Sigma tq)\times 100, \text{ in which:}$$

B' is an apparent zinc content (% by mass); A is a Cu concentration (% by mass); B is a Zn concentration (% by mass); t is Zn equivalent; and q is a concentration of a third element added (% by mass).

The zinc equivalent of each added element is as shown in Table 1. The third element may be added or may not be added. For example, the base material is allowed to contain, in addition to Zn, one or more elements selected from the group consisting of Si, Al, Sn, Mg, Pb, Cd, Fe, Mn and Ni such that the apparent zinc content is from 34 to 38% by mass. The total content of such third element(s) may typically be 1% by mass or less, and more typically 0.5% by mass or less, for example from 0.001 to 0.2% by mass.

TABLE 1-1

| Third Element | Si | Al | Sn | Mg | Pb | Cd | Fe | Mn |
|---|---|---|---|---|---|---|---|---|
| Zinc Equivalent (per 1% by mass) | 10.0 | 6.0 | 2.0 | 2.0 | 1.0 | 1.0 | 0.9 | 0.5 |

TABLE 1-2

| Third Element | Ni |
|---|---|
| Zinc Equivalent (per 1% by mass) | −1.3 |

The reason that the allowable apparent zinc content is narrow is as follows. An excessively higher ratio of the β phase adversely affects the cold workability and the mold life, but it is highly significant that a small amount of the β phase is present in order to improve season cracking resistance. The apparent zinc content of 34% by mass or more can allow introduction of the β phase into a cast material. However, if the Zn concentration exceeds 38% by mass, the cold workability is poor in a diffusion distance range considered in the present invention, and the mold life is affected. On the other hand, complete annealing can eliminate the β phase, but cannot provide the season cracking resistance. Therefore, in the present invention, the apparent zinc content in the copper alloy is from 34 to 38% by mass. The apparent zinc content may preferably be from 35 to 37% by mass.

In one embodiment, the fastener element according to the present invention can be configured of a base material having a copper alloy composition which contains from 34 to 38% by mass of Zn and optionally contains one or more third elements selected from the group consisting of Si, Al, Sn, Mg, Pb, Cd, Fe, Mn and Ni such that the apparent zinc content is from 34 to 38% by mass, the balance being copper and inevitable impurities. In one preferable embodiment, the fastener element according to the present invention can be configured of a base material having a copper alloy composition which contains from 35 to 37% by mass of Zn and optionally contains one or more third elements selected from the group consisting of Si, Al, Sn, Mg, Pb, Cd, Fe, Mn and Ni such that the apparent zinc content is from 35 to 37% by mass, the balance being copper and inevitable impurities. The inevitable impurities refer to acceptable impurities because although they are inherently unnecessary elements, which may be present in raw materials or inevitably mixed in producing steps, they are present in a miner amount and have no effect on properties. In the present invention, the content of each impurity element that is acceptable as inevitable impurities is generally 0.1% by mass or less, and preferably 0.05% by mass or less.

(2. Structure)

In one embodiment, the base material for configuring the fastener element according to the present invention has a dendrite structure. With the dendrite structure, the season cracking resistance can be significantly improved irrespective of the presence or absence of the β phase. In particular, it is preferable that leg portions of the fastener element and an inner surface of a crotch portion which will be in contact with a fastener tape have the dendrite structure in order to improve the season cracking resistance. While the fastener element can be produced by melting and casting a wire and then sequentially carrying out drawing, annealing, cold rolling and cutting. The dendrite structure is a dendritic structure which can be developed during continuous casting of a wire. Conventionally, the dendrite structure has been recrystallized and eliminated in an annealing step carried out for the purpose of removing processing strain or softening the processed material. Therefore, in order to maintain the dendrite structure, it is important to suppress recrystallization in the producing steps of the fastener element.

In the annealing process, a diffusion coefficient D of copper in the copper alloy is expressed by the equation (1):

$$D=D_0\cdot\exp(-Q/(RT)) \quad (1)$$

in which $D_0$ is 0.2 $cm^2$/sec; Q is 47.1 kcal/mol; R is gas constant (8.31446 J/(mol·K)); and T represents a heating temperature (K).

A diffusion distance L is expressed by the following equation (2):

$$L=\sqrt{(Dt)} \quad (2)$$

in which D represents the diffusion coefficient; and t represents a heating time.

The dendrite structure can be maintained by carrying out the annealing step under temperature and time conditions such that the diffusion distance is 3.0 nm or less, and preferably 2.5 nm or less. However, to increase the mold life, the annealing step is preferably carried out under temperature and time conditions such that the diffusion distance is 0.5 nm or more, and more preferably under temperature and time conditions such that the diffusion distance is 1.0 nm or more. The presence of the dendrite structure can be confirmed by microscope observation. In a preferred embodiment, the base material for configuring the fastener element according to the present invention has no recrystallized structure. It should be noted that although the state of the dendrite structure changes depending on the diffusion distance, it is very difficult to express it from the results of observation of the structure.

(3. Ratio of β Phase)

The presence of the β phase can exhibit improved season cracking resistance. The apparent zinc content of 34% by mass or more can allow the β phase to be present during solidification of the casting. In one embodiment, the copper alloy fastener element according to the present invention has the β phase. Therefore, in terms of improving the season cracking resistance, a higher ratio of the β phase is preferable, and the ratio may be, for example, 1% or more, and preferably 2% or more. However, an increase in the ratio of the β phase adversely affects the mold life. Further, in the present invention, the base material for configuring the fastener element has the dendrite structure, and the improved season cracking resistance can be obtained without greatly increasing the ratio of the β phase. Therefore, the ratio of the β phase is preferably 10% or less, and more preferably 8% or less.

The ratio of the β phase can be calculated by the following method. A surface of the base material is polished with SiC waterproof abrasive paper and mirror-finished with diamond to expose a cross section perpendicular to a rolling surface, and the cross section is analyzed by an X ray diffraction method (θ-2θ method) to calculate an integrated value of peak intensities of the α phase and the β phase, as follows: the ratio of the β phase ratio (%)=(an integrated value of β phase peak intensity)/(an integrated value of α phase peak intensity+an integrated value of β phase peak intensity)×100.

(4. Method for Producing Fastener Element)

Hereinafter, an example of a method for producing the fastener element according to the present invention will be described. The copper zinc alloy having the above composition is heated and melted, and a wire is then continuously cast in one direction. By continuously casting the wire in one direction, the dendrite structure can be developed. Also, rapid cooling of the wire during the casting tends to easily generate the β phase. Subsequently, the surface of the wire is smoothed as needed, and respective steps of wire drawing, annealing and cold rolling are then carried out in this order to produce a deformed wire 10 having a substantially Y-shaped cross section corresponding to the shape of the element, as shown in FIG. 1. It is important to maintain the dendrite structure by carrying out the annealing step under the diffusion distance conditions as described above. Subsequently, using a cutting mold equipped with a punch and a die, the deformed wire 10 having the substantially Y-shaped cross section is cut at desired intervals in a direction perpendicular to the longitudinal direction of the deformed wire to form a plurality of Y-shaped members 20.

Figure 2:
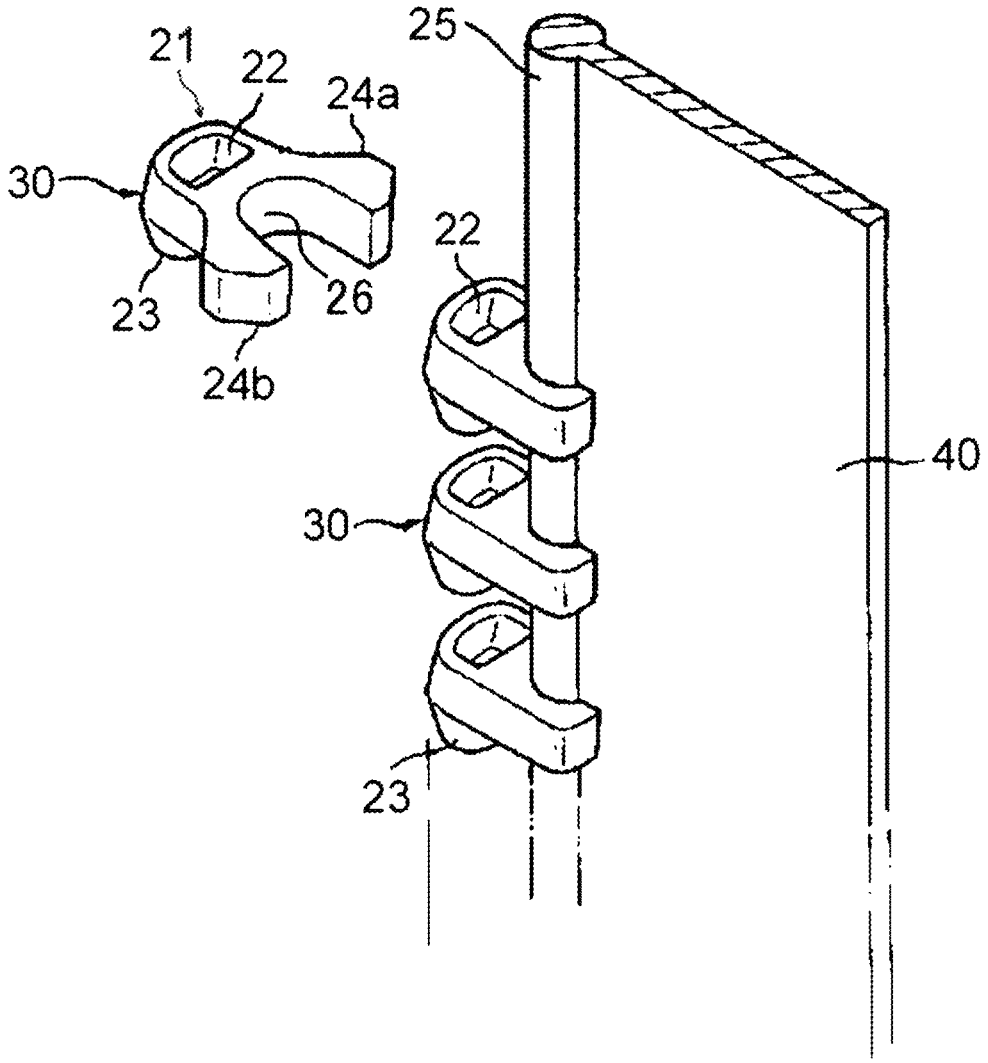
FIG. 2 is a view for explaining a method of attaching fastener elements to a fastener tape.

A shape of a head portion can be formed by pressing each Y-shaped member 20, thereby completing the production of the fastener element. As shown in FIG. 2, the pressing into the shape of the head portion can be carried out by press-forming an engaging concave portion 22 and an engaging convex portion 23 on upper and lower surfaces of a head portion 21 of each Y-shaped member 20 by means of a forming punch. In one embodiment, the fastener element thus produced includes: a pair of leg portions 24*a*, 24*b*; a crotch portion 26 connecting the leg portions 24*a*, 24*b*; a head portion 21 provided from the crotch portion 26 in a direction opposite to an extending direction of the leg portions 24*a*, 24*b* and having the engaging concave portion 22 and the engaging convex portion 23.

A plurality of fastener elements obtained by the producing method as described above are prepared and the plurality of fastener elements are fixed to one side edge of a fastener tape at predetermined intervals to form an element row. A fastener stringer having the element row implanted into one side edge of the fastener tape can be thus produced. The method for fixing the element row to one side edge of the fastener tape includes, but not limited to, cold working involving bending process and caulking operation in a direction where the leg portions approach each other. As illustrated in FIG. 2, it is preferable that a core cord portion 25 having an increased thickness is formed on one side edge of a fastener tape 1 in order to increase the fixing strength to the leg portions 24*a*, 24*b* of each fastener element 30.

An inner side surface of the crotch portion 26 where the fastener element 30 is brought into contact with the core cord portion 25, as well as respective inner side surfaces of the leg portions 24*a*, 24*b* are portions which directly affect the fixing strength of the fastener element 30 to the fastener tape 1, and which tend to generate residual stress when bending process and caulking operation are performed and tend to undergo tensile stress in use, so that these portions are particularly required to exhibit the season cracking resistance. Therefore, in the fastener element 30, the inner side surface of the base material in the crotch portion 26 that will be in contact with the core cord portion 25 preferably has the dendrite structure, and more preferably the respective inner side surfaces of the leg portions 24*a*, 24*b* also have the dendrite structure. Further, positions other than the respective inner side surface of the crotch portion 26 and the inner side surfaces of the leg portions 24*a*, 24*b* may have the dendrite structure, and the entire fastener element may have the dendrite structure.

(5. Surface Treatment)

The base material for configuring the fastener element may be optionally subjected to various surface treatments. For example, the base material may be subjected to a smoothing treatment, a rust prevention treatment, a clear coating treatment, a plating treatment or the like. The surface treatment can be performed before and/or after implanting the elements into the fastener tape. In particular, it is preferable to further carry out the rust prevention treatment (a rust prevention step+a water washing step+a drying step) after performing the smoothing treatment. Furthermore, after the rust prevention treatment or without the rust prevention treatment, the clear coating treatment (a coating step+a drying step) or the plating treatment may be further carried out to improve a corrosion resistance, a weather resistance and the like. As a final step, waxing may be carried out to reduce a sliding resistance.

(6. Slide Fastener)

Figure 3:
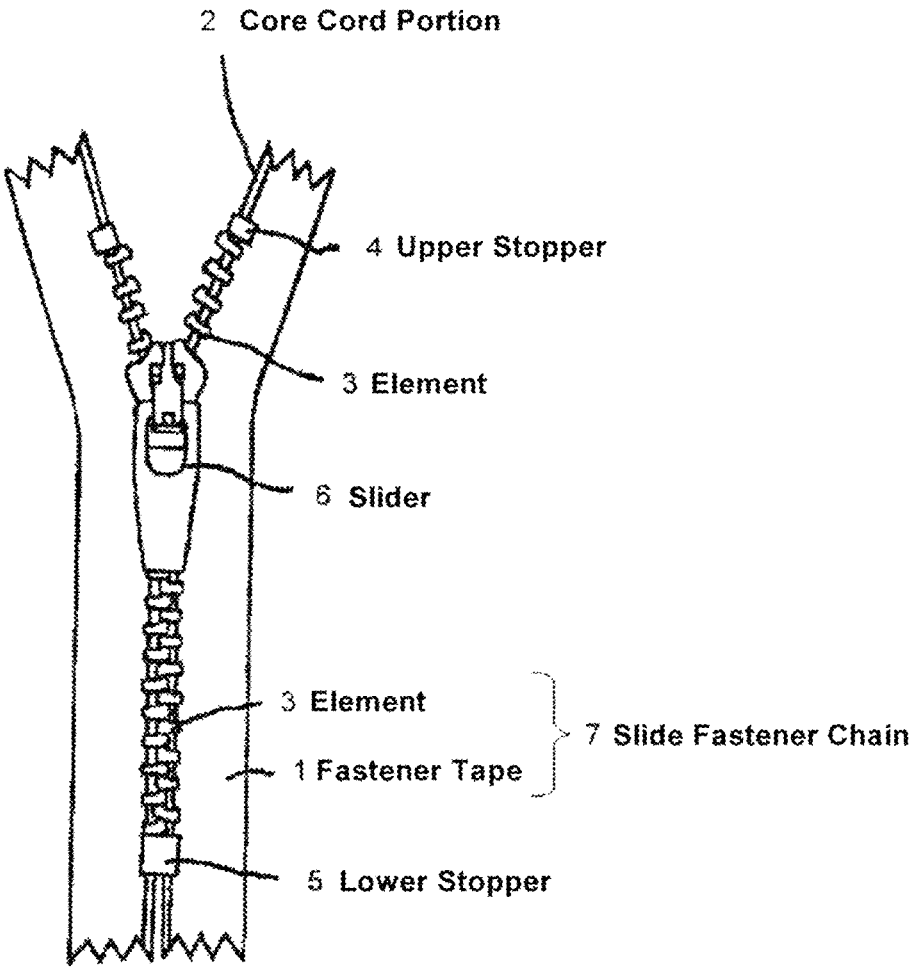
FIG. 3 is a schematic front view of a slide fastener.

An example of the slide fastener provided with the fastener elements according to the present invention will be described with reference to the figure. FIG. 3 is a schematic view of the slide fastener. As shown in FIG. 3, the slide fastener includes: a pair of fastener tapes 1 each having a core cord portion 2 formed on one side edge; elements 3 caulked and fixed (attached) to the core cord portion 2 of each fastener tape 1 at predetermined intervals; top stops 4 and a bottom stop 5 caulked and fixed to the core cord portion 2 of each fastener tape 1 at the upper end and the lower end of the row of the elements 3, respectively; and a slider 6 arranged between a pair of the opposing elements 3 and slidable in the up and down direction so as to engage and disengage the pair of the elements 3. An article in which the elements 3 have been attached along one side edge of one fastener tape 1 is referred to as a slide fastener stringer, and an article in which the elements 3 attached to the core cord portions 2 of a pair of the fastener tapes 1 have been engaged with each other is referred to as a slide fastener chain 7.

The slide fastener can be attached to various articles, and particularly functions as an opening/closing tool. The articles to which the slide fastener is attached include, but not limited to, daily necessities such as clothes, bags, shoes and miscellaneous goods, as well as industrial goods such as water storage tanks, fishing nets and space suites.

Examples

Hereinafter, Examples of the present invention are illustrated, but they are provided for better understanding of the present invention and its advantages, and are not intended to limit the present invention.

Cu (purity of 99.99% by mass or more) and Zn (purity of 99.9% by mass or more) as raw materials were blended so as to have each alloy composition according to the test number as shown in Table 2, and melted in a heating furnace, and a wire (round wire) having a circular cross section was continuously casted in one direction with a continuous casting machine while rapidly cooling the wire. After drawing the wire, it was annealed under heating conditions where a diffusion distance of copper was each value as shown in Table 2. A deformed wire having a substantially Y-shaped cross section (hereinafter referred to as "Y-bar") was then produced by cold rolling. The ratio of the β phase was controlled by changing the heating temperature and the cooling condition during the annealing before the cold rolling. The ratio of the β phase tends to be decreased as the heating temperature in the annealing is increased, and conversely tends to be increased as the heating temperature in the annealing is decreased. Further, the ratio of the β phase tends to be decreased as the cooling rate in the annealing is decreased, and conversely tends to be increased as the cooling rate in the annealing is increased.

The Y-bar was then sequentially cut using a cutting mold equipped with a punch and a die to obtain a large number of Y-shaped members, and an engaging concave portion and an engaging convex portion were press-molded on top and bottom surfaces of the head portion of each Y-shaped member by means of a forming punch to prepare fastener elements corresponding to M and L grade chain widths defined in JIS S 3015: 2007.

<Structure Observation>

Figure 4:
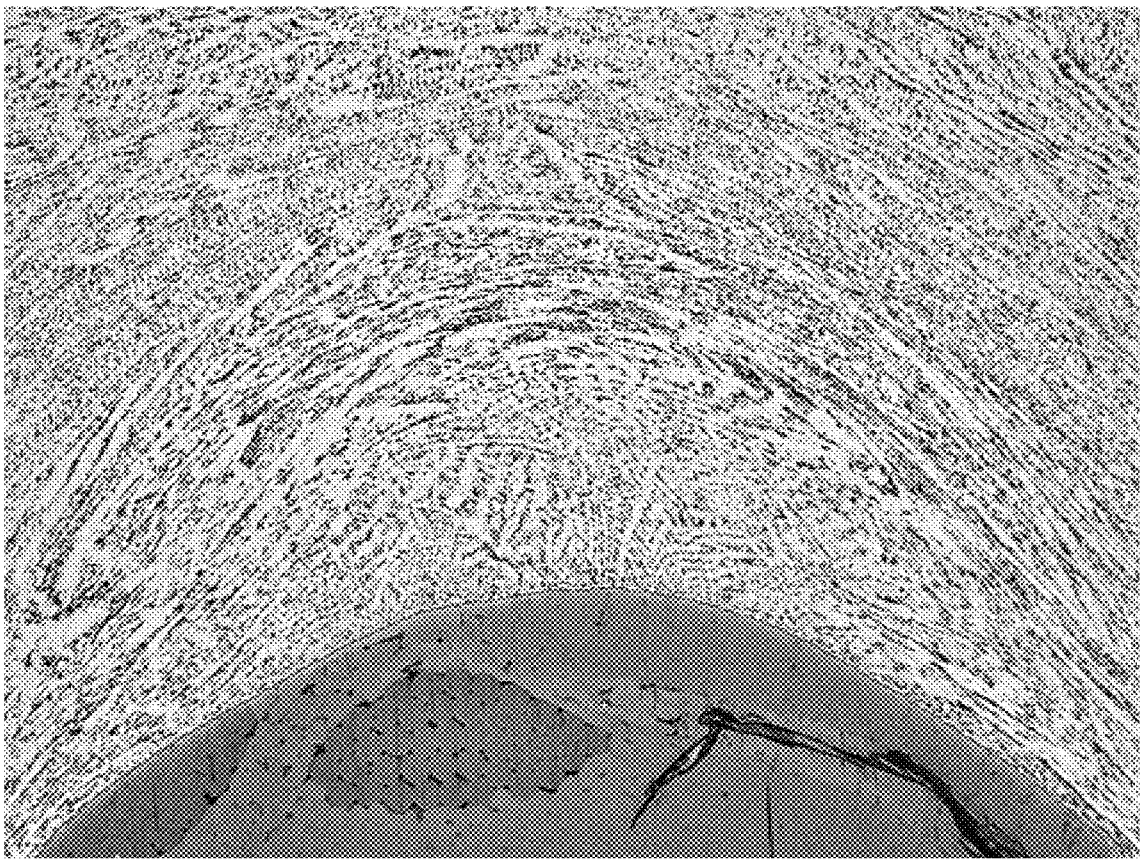
FIG. 4 is a microscope photograph showing an example of a dendrite structure observed in a fastener element of Test No. 3-5.
Figure 5:
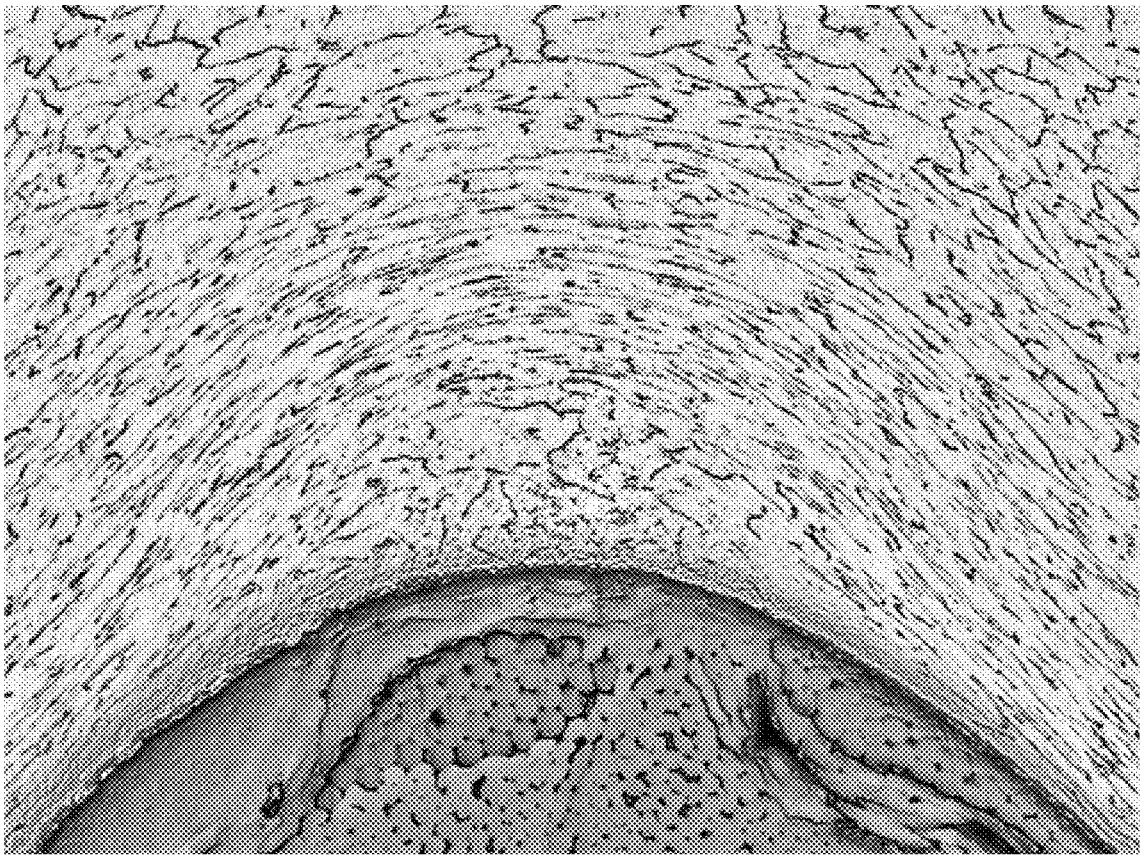
FIG. 5 is a microscope photograph showing an example of a recrystallized structure observed in a fastener element of Test No. 1-4.

After polishing and etching the inner side surface of the crotch portion of each fastener element obtained as described above, the structure was observed by microscope observation. In Table 2, a fastener element in which a dendrite structure was developed was denoted by "Dendrite" and a fastener element in which a recrystallized structure was developed was denoted by "Recrystallized". Further, the ratio of the β phase was calculated by the method as described above. Specifically, for any one of the resulting elements, a cross-sectional structure perpendicular to the rolled surface was observed with a cross-sectional photograph. The cross section perpendicular to the rolling surface was exposed by polishing each element using SiC waterproof abrasive papers (from #180 to #2000), and the cross section was further subjected to mirror finishing using diamond pastes having average particle sizes of 3 μm and 1 μm in this order to obtain a sample, and the sample was then subjected to measurement by X-ray diffraction. Using GADDS-Discover 8 available from Bruker AXS Inc. as a measuring apparatus, each peak intensity integrated value of the α and β phases was calculated for a measuring time of 90 s for a lower angle side and 120 s for a higher angle side. The ratio of the β phase was calculated according to the equation: the ratio of the β phase (%)=(peak intensity integrated value of β phase)/(peak intensity integrated value of α phase+peak intensity integrated value of β phase)×100. The results are shown in Table 2. FIG. 4 shows a microscopic photograph showing an example of the dendrite structure observed in the fastener element of Test No. 3-5. In addition, FIG. 5 shows a microscopic photograph showing an example of the recrystallized structure observed in the fastener element of Test No. 1-4. It should be noted that the dendrite structure was observed not only at the inner side surface of the crotch portion but also at the leg portions and the head portion of the fastener elements evaluated as "Dendrite".

<Life of Cutting Mold>

When a large number of Y-shaped members were produced by sequentially cutting Y-bar using a cutting mold equipped with a punch and a die in the steps of producing each fastener element, the number of cutting until abnormality was generated in the shape of the Y-shaped member under each condition was investigated, and evaluated according to the following criteria, with the proviso that the number of cutting in Example 1-1 was 100%. The results are shown in Table 2.

seen that the fastener elements having a lower ratio of the β phase while at the same time having the dendritic structure improved mold life and a large number of elements was able to be produced with the same mold. However, the fastener elements having the recrystallized structure could not have excellent season cracking resistance when the ratio of the β phase was lower.

TABLE 2

| Test Nos. | Composition (mass %) | Diffusion Distance (nm) | Structure | β Phase Ratio (%) | Mold Life | Season Cracking Resistance | Example or Comparative Example | M or L |
|---|---|---|---|---|---|---|---|---|
| Example 1-1 | Cu—35%Zn | 77.0 | Recrystallized | 0.0 | ○ | x | Comp. | M |
| Example 1-2 | Cu—35%Zn | 1.1 | Dendrite | 5.0 | ○ | ○ | Example | M |
| Example 1-3 | Cu—35%Zn | 1.1 | Recrystallized | 0.0 | ○ | x | Comp. | M |
| Example 1-4 | Cu—35%Zn | 1.1 | Recrystallized | 5.8 | ○ | x | Comp. | M |
| Example 1-5 | Cu—35%Zn | 1.1 | Recrystallized | 7.5 | ○ | x | Comp. | M |
| Example 1-6 | Cu—35%Zn | 1.1 | Recrystallized | 7.9 | ○ | x | Comp. | M |
| Example 1-7 | Cu—35%Zn | 1.1 | Recrystallized | 10.0 | x | ○ | Comp. | M |
| Example 1-8 | Cu—35%Zn | 0.0 | Dendrite | 10.4 | x | ○ | Comp. | M |
| Example 2-1 | Cu—39%Zn | 77.8 | Recrystallized | 5.6 | ○ | x | Comp. | M |
| Example 2-2 | Cu—39%Zn | 40.5 | Recrystallized | 11.5 | Δ | x | Comp. | M |
| Example 2-3 | Cu—39%Zn | 116.9 | Recrystallized | 14.3 | x | ○ | Comp. | M |
| Example 2-4 | Cu—39%Zn | 677.7 | Recrystallized | 19.0 | x | ○ | Comp. | M |
| Example 2-5 | Cu—39%Zn | 2.1 | Dendrite | 21.8 | x | ○ | Comp. | M |
| Example 3-1 | Cu—35%Zn | 77.8 | Recrystallized | 0.0 | ○ | x | Comp. | L |
| Example 3-2 | Cu—35%Zn | 0.6 | Dendrite | 9.4 | Δ | ○ | Example | L |
| Example 3-3 | Cu—35%Zn | 0.6 | Dendrite | 9.4 | Δ | ○ | Example | L |
| Example 3-4 | Cu—35%Zn | 1.5 | Dendrite | 2.5 | ○ | ○ | Example | L |
| Example 3-5 | Cu—35%Zn | 1.5 | Dendrite | 5.0 | ○ | ○ | Example | L |
| Example 3-6 | Cu—35%Zn | 2.1 | Dendrite | 1.3 | ○ | ○ | Example | L |

○ (circle): a case of 80% or more and less than 100%;
Δ (triangle): a case of 60% or more and less than 80%; and
x (cross): a case of 0% or more and less than 60%.

<Season Cracking Resistance>

The evaluation of the season cracking resistance was carried out by measuring the strength of each fastener element before and after an ammonia exposure test based on JBMA-T301 (Japan Copper and Brass Association Technical Standard), and investigating a strength retention ratio of strength after ammonia exposure versus strength before ammonia exposure. The measurement of the strength was carried out by attaching the element of each test example to a core cord portion formed on one side edge of a polyester fastener tape by performing a bending process and a caulking operation, and then performing an element pull-out test. The pull-out test was carried out, using an Instron type tensile tester, by grasping the engaging head of one element with a jig, pulling it at a pulling rate of 300 mm/min until the element was pulled out from the fastener tape fixed to a clamp, while measuring the maximum strength during the operation. The pulling direction of the element was a direction perpendicular to the longitudinal direction of the fastener tape and parallel to the fastener tape surface. Each measured result is reported as an average value after conducting the measurement six times, and the evaluation was carried out under the following criteria. The results are shown in Table 2.

○ (circle): a case of 70% or more and less than 100%; and
x (cross): a case of less than 70%.

<Discussion>

The results of the tests are shown in Table 2. From the results, it is understood that the fastener elements having the dendrite structure corresponding to the embodiment of the present invention had the excellent season cracking resistance, even when the ratio of the β phase was lower, let alone when the ratio of the β phase was higher. Further, it can be

DESCRIPTION OF REFERENCE NUMERALS

1 fastener tape
2 core cord portion
3 element
4 top stop
5 bottom stop
6 slider
7 slide fastener chain
10 deformed wire
20 Y-shaped member
21 head portion
22 engaging concave portion
23 engaging convex portion
24*a*, 24*b* leg portion
25 core cord portion
30 element
40 fastener tape

What is claimed is:

1. A copper alloy fastener element comprising a copper-zinc alloy as a base material, the base material having: an apparent zinc content of from 34 to 38% by mass; a dendrite structure; and a β phase at a ratio of 10% or less.

2. The copper alloy fastener element according to claim 1, wherein the base material contains from 34 to 38% by mass of Zn.

3. The copper alloy fastener element according to claim 1, wherein the copper alloy fastener comprises: a pair of leg portions for being fixed by sandwiching to a core cord portion provided on one side edge of a fastener tape; a crotch portion for connecting the leg portions; and a head portion provided from the crotch portion in a direction opposite to the leg portions, the head portion comprising an engaging concave portion and an engaging convex portion, and wherein the base material on an inner side surface of the crotch portion to be in contact with the core cord portion has at least the dendrite structure.

4. The copper alloy fastener element according to claim 1, wherein the ratio of the β phase in the base material is from 2 to 10%.

5. The copper alloy fastener element according to claim 1, wherein the base material has been produced through an annealing step under heating conditions where a diffusion distance of copper is from 0.5 to 3.0 nm, after casting.

6. A fastener chain comprising at least one copper alloy fastener element according to claim 1.

7. A slide fastener comprising the fastener chain according to claim 6.

8. An article comprising the slide fastener according to claim 7.

9. The copper alloy fastener element according to claim 1, wherein the ratio of the β phase in the base material is 8% or less.

* * * * *